US009104151B2

(12) United States Patent
Kusumoto

(10) Patent No.: US 9,104,151 B2
(45) Date of Patent: Aug. 11, 2015

(54) FIXING DEVICE AND IMAGE FORMING APPARATUS

(71) Applicant: KYOCERA DOCUMENT SOLUTIONS INC., Osaka (JP)

(72) Inventor: Hiroshi Kusumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/106,396

(22) Filed: Dec. 13, 2013

(65) Prior Publication Data

US 2014/0169820 A1 Jun. 19, 2014

(30) Foreign Application Priority Data

Dec. 14, 2012 (JP) ..... 2012-273162

(51) Int. Cl.
*G03G 15/20* (2006.01)

(52) U.S. Cl.
CPC ..... *G03G 15/2053* (2013.01)

(58) Field of Classification Search
CPC ..... G03G 15/2039; G03G 15/2078
USPC ..... 399/69
See application file for complete search history.

(56) References Cited

U.S. PATENT DOCUMENTS

2003/0002895 A1* 1/2003 Kato et al. ..... 399/333
2011/0020018 A1* 1/2011 Takenaka et al. ..... 399/33

FOREIGN PATENT DOCUMENTS

JP 2002-072736 A 3/2002

* cited by examiner

*Primary Examiner* — Clayton E Laballe
*Assistant Examiner* — Noam Reisner
(74) *Attorney, Agent, or Firm* — Studebaker & Brackett PC

(57) ABSTRACT

A fixing device includes a heating member, a pressing member, a first heating source, a second heating source and a reflection body. The reflection body reflects radiant heat irradiated from the first heating source toward a fixing nip side portion of the heating member and blocks radiant heat irradiated from the second heating source toward the fixing nip side portion of the heating member. After the heating of the heating member by either one of the heating sources is started until the heating member is heated to the sheet-passable temperature, an amount of radiant heat from the second heating source is larger than that of radiant heat from the first heating source, and after the heating member is heated to the sheet-passable temperature, an amount of radiant heat from the first heating source is larger than that of radiant heat from the second heating source.

18 Claims, 3 Drawing Sheets

FIXING DEVICE AND IMAGE FORMING APPARATUS

INCORPORATION BY REFERENCE

This application is based on and claims the benefit of priority from Japanese Patent application No. 2012-273162 filed on Dec. 14, 2012, the entire contents of which are incorporated herein by reference.

BACKGROUND

The present disclosure relates to a fixing device configured to fix a toner image on a sheet and an image forming apparatus provided with the fixing device.

In the fixing device provided at an electrographic image forming apparatus, a heating member (for example, a heating roller or a heating belt) and a pressing member (for example, a pressing roller) are pressed each other to form a fixing nip. And, at the fixing nip, the sheet is heated and pressed to fix the toner image on the sheet. Such a fixing device applies a configuration that a heating source housed in the heating member heats the heating member.

For example, there exists a fixing device having a configuration that the heating member houses a plurality of heating sources which generates radiant heat so as to heat the heating member. In the fixing device, a reflecting plate arranged between the plurality of heating sources reflects the radiant heat irradiated from one of the heating sources to another of the heating sources so as to increases a heating efficiency of the heating member.

As mentioned above, since the heating member is pressed against the pressing member at the fixing nip, when the heating member is heated by the heating sources housed in the heating member, the heat escapes from the heating member to the pressing member via the fixing nip. This may require a warm-up time longer than necessary. The warm-up time means a period required to heat the heating member up to a sheet-passable temperature after the heating of the heating member is started.

SUMMARY

In accordance with an embodiment of the present disclosure, a fixing device includes a heating member, a pressing member, a first heating source, a second heating source, a reflection body, a storage part and a controller. The heating member is rotatably provided. The pressing member is rotatably provided and pressed against the heating member to form a fixing nip between the heating member and the pressing member. The first heating source and a second heating source are housed in the heating member. The reflection body is housed in the heating member. The reflection body is configured to reflect radiant heat irradiated from the first heating source toward a fixing nip side portion of the heating member. The reflection body is configured to block radiant heat irradiated from the second heating source toward the fixing nip side portion of the heating member. The storage part stores a sheet-passable temperature at which a toner image can be fixed on a sheet at the fixing nip. The controller controls operation/stop of the operation of the first heating source and the second heating source so as to make an amount of radiant heat from the second heating source larger than an amount of radiant heat from the first heating source after the heating of the heating member by at least either one of the first heating source and the second heating source is started until the heating member is heated to the sheet-passable temperature and so as to make an amount of radiant heat from the first heating source larger than an amount of radiant heat from the second heating source after the heating member is heated to the sheet-passable temperature.

In accordance with an embodiment of the present disclosure, an image forming apparatus includes a fixing device. The fixing device has a heating member, a pressing member, a first heating source, a second heating source, a reflection body, a storage part and a controller. The heating member is rotatably provided. The pressing member is rotatably provided and pressed against the heating member to form a fixing nip between the heating member and the pressing member. The first heating source and a second heating source are housed in the heating member. The reflection body is housed in the heating member. The reflection body is configured to reflect radiant heat irradiated from the first heating source toward a fixing nip side portion of the heating member. The reflection body is configured to block radiant heat irradiated from the second heating source toward the fixing nip side portion of the heating member. The storage part stores a sheet-passable temperature at which a toner image can be fixed on a sheet at the fixing nip. The controller controls operation/stop of the operation of the first heating source and the second heating source so as to make an amount of radiant heat from the second heating source larger than an amount of radiant heat from the first heating source after the heating of the heating member by at least either one of the first heating source and the second heating source is started until the heating member is heated to the sheet-passable temperature and so as to make an amount of radiant heat from the first heating source larger than an amount of radiant heat from the second heating source after the heating member is heated to the sheet-passable temperature.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
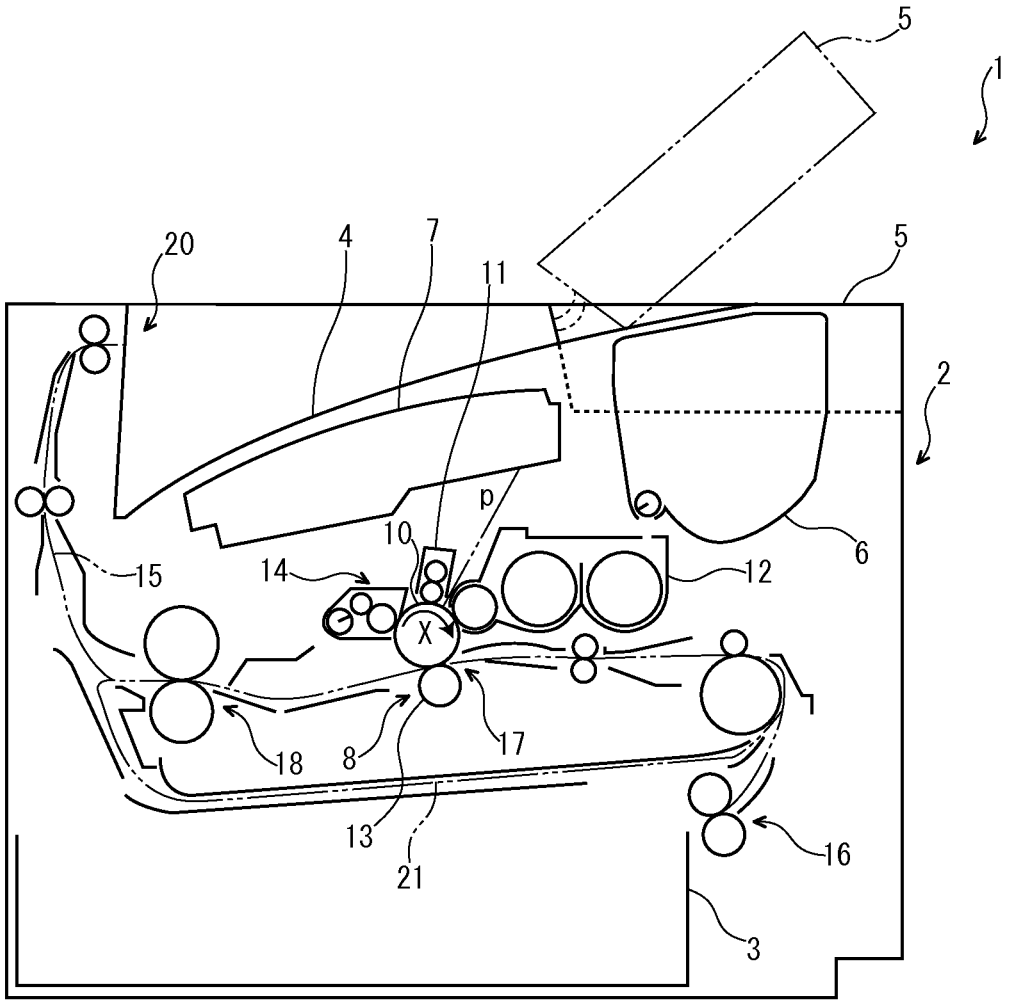
FIG. 1 is a schematic diagram schematically showing a printer according to an embodiment of the present disclosure.

First, with reference to FIG. 1, the entire structure of an electrographic printer 1 (an image forming apparatus) will be described. FIG. 1 is a schematic diagram schematically showing the printer according to an embodiment of the present disclosure.

As shown in FIG. 1, the printer 1 includes a box-formed printer main body 2. In a lower part of the printer main body 2, a sheet feeding cartridge 3 storing sheets (not shown) is provided and, on an upper surface of the printer main body 2, a sheet ejecting tray 4 is provided. On the upper surface of the printer main body 2, an upper cover 5 is provided openably and closably near the sheet ejecting tray 4. Below the upper cover 5, a toner container 6 is stored.

As shown in FIG. 1, in an upper part of the printer main body 2, an exposure device 7 consisting of a laser scanning unit (LSU) is arranged. Below the exposure device 7, an image forming unit 8 is provided. In the image forming unit 8, a photosensitive drum 10 for an image carrier is rotatably provided. Around the photosensitive drum 10, a charger 11, a developing device 12, a transferring roller 13 and a cleaning device 14 are arranged along the rotational direction of the photosensitive drum 10 (refer to an arrow X in FIG. 1).

In the printer main body 2, a sheet conveying path 15 is provided. At an upper stream end of the conveying path 15, a sheet feeder 16 is provided. At an intermediate stream part of the conveying path 15, a transferring unit 17 formed by the photosensitive drum 10 and the transferring roller 13 is provided. At a lower stream part of the conveying path 15, a fixing device 18 is provided. At a lower stream end of the conveying path 15, a sheet ejecting part 20 is provided. Below the conveying path 15, an inversion path 21 for duplex printing is formed.

Next, the operation of forming an image by the printer 1 having the above-mentioned configuration will be described.

When the power is supplied to the color printer 1, various parameters are initialized and initial determination, such as temperature determination of the fixing device 18, is carried out. Subsequently, when image data is inputted and a printing start is directed from a computer or the like connected with the printer 1, the image forming operation is carried out as follows.

First, the surface of the photosensitive drum 10 is electrically charged by the charger 11. Then, the surface of the photosensitive drum 10 is exposed corresponding to the image data with a laser (refer to a two-dot line P in FIG. 1) from the exposure device 7, thereby forming an electrostatic latent image on the surface of the photosensitive drum 10. The electrostatic latent image is developed to a toner image with the toner (developer) by the development device 12.

On the other hand, a sheet fed from the sheet feeding cartridge 3 by the sheet feeder 16 is conveyed to the transferring unit 17 in a suitable timing for the above-mentioned image forming operation. Then, in the transferring unit 17, the toner image on the photosensitive drum 10 is transferred onto the sheet. The sheet with the transferred toner image is conveyed to a lower stream side on the conveying path 15 to enter the fixing device 18, and then, the toner image is fixed on the sheet in the fixing device 18. The sheet with the fixed toner image is ejected from the sheet ejecting part 20 on the sheet ejecting tray 4. The toner remained on the photosensitive drum 10 is collected by the cleaning device 14.

Next, with reference to FIG. 2, the configuration of the fixing device 18 will be described. An arrow Y in FIG. 2 indicates a sheet conveying direction. Hereinafter, for convenient explanation, the front side viewed from the paper plane of FIG. 2 is defined as a front side of the fixing device 18.

Figure 2:
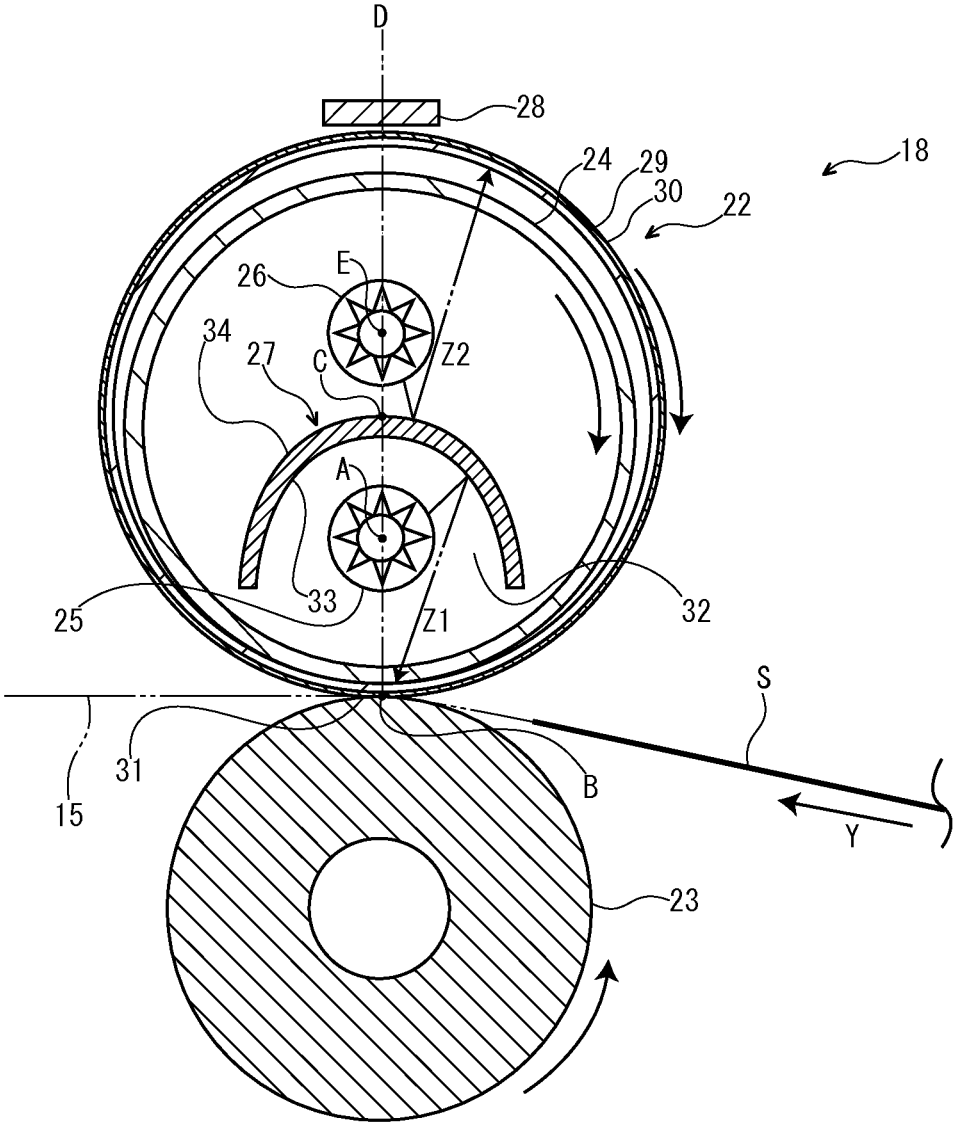
FIG. 2 is a sectional view showing a fixing device of the printer according to the embodiment of the present disclosure.

As shown in FIG. 2, the fixing device 18 has a heating belt 22 (a heating member), a pressing roller 23 (a pressing member) arranged under the heating belt 22, a hollow roller 24 arranged inside the heating belt 22, a first heating source 25 housed in the lower space of the heating belt 22 and the hollow roller 24, a second heating source 26 housed in the upper space of the heating belt 22 and the hollow roller 24, a reflection plate 27 (a reflection body) housed in the heating belt 22 and the hollow roller 24 and provided so as to cover the upper side and the left and right sides of the first heating source 25 and a temperature sensor 28 arranged above the heating belt 22. Hereinafter, each of the components will be described in the above-mentioned order.

First, the heating belt 22 will be described. The heating belt 22 is composed of an endless belt and formed in a cylindrical shape. The heating belt 22 has an-extended shape in the forward and backward directions (a depth direction of the paper in FIG. 2) and is rotatably stored in a fixing frame (not shown). The heating belt 22 is made of a substrate layer 29 and a release layer 30 which covers the substrate layer 29, for example. The substrate layer 29 is made from transparent resin, such as PI (polyimide), and formed in a cylindrical shape. The inner circumference face of the substrate layer 29 (which is also the inner circumference face of the entire of the heating belt 22) is coated with a coating material which changes an infrared ray into heat. The release layer 30 is made from transparent fluoroethylene resin, such as PFA (Perfluoroalkoxy alkane), and formed in a tubular shape. As mentioned above, the heating belt 22 is formed by laminating the transparent resins. The "transparent" means that a degree of transparency is not 0. Accordingly, "a transparent resin" includes semitransparent resins.

Next, the pressing roller 23 will be described. The pressing roller 23 is formed in an-extended shape in the forward and backward directions and rotatably stored in the fixing frame (not shown). The pressing roller 23 is composed of a core material, an elastic layer provided around the core material and a release layer which coats the elastic layer, for example. The core material of the pressing roller 23 is made from metal, such as aluminum and iron, and formed in a cylindrical shape. The elastic layer of the pressing roller 23 is made from silicon rubber or the like. The release layer of the pressing roller 23 is made from fluoroethylene resin, such as PFA (Perfluoro alkoxy alkane).

The pressing roller 23 faces the heating belt 22 across the sheet conveying path 15. The pressing roller 23 is pressed against the heating belt 22 by a biasing force of a biasing member (not shown) and forms a fixing nip 31 between the heating belt 22 and the pressing roller 23. And, by heating and pressing the sheet (refer to a pointing line S of FIG. 2) at the fixing nip 31, the toner image is fixed on the sheet. The pressing roller 23 is pressed against the heating belt 22 as mentioned above so as to be rotated in the direction opposite to the rotational direction of the heating belt 22 with the rotation of the heating belt 22 (refer to an arrow of FIG. 2).

Next, the hollow roller 24 will be described. The hollow roller 24 is formed in an-extended shape in the forward and backward direction and rotatably stored in the fixing frame (not shown). The hollow roller 24 is formed in a cylindrical shape. The hollow roller 24 is made from heat-resistant glass, such as pyroceram (trademark) used for dishes or the like or crystal glass used for an outer sheath of a halogen heater, and has transparency. The "having transparency" means that a degree of transparency is not 0. Accordingly, "the transparent hollow roller 24" includes a semitransparent hollow roller 24.

The above-mentioned heating belt 22 is provided around the hollow roller 24. Since the lower portion of the outer circumference face of the hollow roller 24 (the fixing nip 31 side portion) comes in contact with the lower portion of the inner circumference face of the heating belt 22 (the fixing nip 31 side portion), when the hollow roller 24 is rotated, the heating belt 22 is rotated in the same rotational direction as the hollow roller 24 (refer to an arrow in FIG. 2). The upper portion and the left and right side portions of the outer circumference face of the hollow roller 24 (the portion spaced away from the fixing nip 31) is provided away from the upper portion and the left and right side portions of the inner circumference face of the heating belt 22 (the portion spaced away from the fixing nip 31) with a gap in between. The gap between the inner circumference face of the heating belt 22 and the outer circumference face of the hollow roller 24 is largest between the upper end of the heating belt 22 and the upper end of the hollow roller 24 (at the ends on the sides spaced away from the fixing nip 31).

Next, the first heating source 25 will be described. The first heating source 25 is composed of a carbon lamp. A center A of the first heating source 25 is positioned on a straight line D passing through a center B of the fixing nip 31 and a rotational center C of the heating belt 22 viewed from the front.

Next, the second heating source 26 will be described. The second heating source 26 is provided away from the fixing nip 31 farther than the first heating source 25 and positioned opposite to the fixing nip 31 across the reflection plate 27. The second heating source 26 is composed of a carbon lamp similar to the first heating source 25. A center E of the second heating source 26 is positioned on the straight line D passing through the center B of the fixing nip 31 and the rotational center C of the heating belt 22 viewed from the front, similar to the center A of the first heating source 25.

Next, the reflection plate 27 will be described. The reflection plate 27 is provided between the first heating source 25 and the second heating source 26. The reflection plate 27 bends upward (toward a side spaced away from the fixing nip 31) to form a storing space 32 opened downward (toward a fixing nip side 31 side). In the storing space 32, almost entire of the first heating source 25 (exactly, a portion expect the lower end potion) is stored. The reflection plate 27 is formed in a symmetrical shape relative to the straight line D passing through the center B of the fixing nip 31 and the rotational center C of the heating belt 22 viewed from the front. The reflection plate 27 is provided so as to separate the inner circumference face of the heating belt 22 into a lower portion (the fixing nip 31 side portion) and the other portion.

On the inner circumference face of the reflection plate 27, a first reflection surface 33 is formed. The first reflection surface 33 is configured to reflect radiant heat irradiated from the first heating source 25 toward the lower portion of the heating belt 22 (the fixing nip 31 side portion) (refer to a two-dot chain line Z1 in FIG. 2). On the outer circumference face of the reflection plate 27, a second reflection surface 34 is formed. The second reflection surface 34 is configured to reflect radiant heat, which is irradiated from the second heating source 26 to the lower portion of the heating belt 22 (the fixing nip 31 side portion), toward the upper portion and the left and right side portions of the heating belt 22 (the portion on a side spaced away from the fixing nip 31) (refer to a two-dot chain line Z2 in FIG. 2). That is, the second reflection surface 34 is provided so as to block the radiant heat irradiated from the second heating source 26 toward the lower portion of the heating belt 22 (the fixing nip 31 side portion).

Next, the temperature sensor 28 will be described. The temperature sensor 28 is composed of a thermistor, for example. The temperature sensor 28 is provided away from the outer circumference face of the heating belt 22 with a predetermined gap in between. That is, the temperature sensor 28 is a non-contact type sensor.

Figure 3:
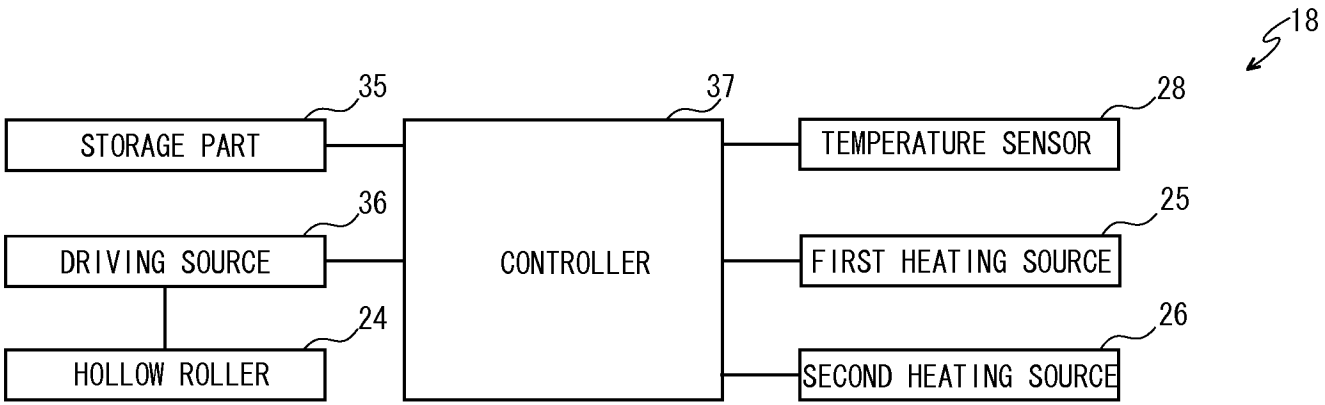
FIG. 3 is a schematic block diagram showing a control system of the fixing device of the printer according to the embodiment of the present disclosure.

Next, with reference to FIG. 3, a control system of the fixing device 18 will be described.

The fixing device 18 is provided with a controller 37. The controller 37 is connected to a storage part 35 composed of ROM (Read Only Memory), RAM (Random Access Memory) and others. The controller 37 is configured to control each part of the fixing device 18 according to a control program and data for control stored in the storage part 35. The storage part 35 stores a sheet-passable temperature T of the heating belt 22. The sheet-passable temperature T of the heating belt 22 is a temperature at which the toner image can be fixed on the sheet at the fixing nip 31. The sheet-passable temperature T is, depending on a machine type, set to 160 degree to 180 degree, for example.

The controller 37 is connected to a driving source 36 composed of a motor and others, and the driving source 36 is connected to the hollow roller 24. According to the signal outputted from the controller 37, the driving source 36 rotates the hollow roller 24.

The controller 37 is connected to the temperature sensor 28. Temperatures of the heating belt 22 detected by the temperature sensor 28 are outputted to the controller 37.

The controller 37 is connected to the first heating source 25 and the second heating source 26. The controller 37 controls operation (light)/stop of the operation of the first heating source 25 and the second heating source 26.

In the fixing device 18 having above-mentioned configuration, a control operation configured to fix the toner image on the sheet will be described.

When the power source of the printer 1 is turned on and a signal for printing is transferred to the controller 37, the controller 37 operates (lights) the second heating source 26. The time at which the second heating source 26 is operated is set to a time t1. When the second heating source 26 is operated, the second heating source 26 irradiates radiant heat. A part of the radiant heat irradiated from the second heating source 26 is transmitted through the transparent hollow roller 24 and reaches the upper portion and the left and right side portions of the inner circumference face of the heating belt 22. Another part of the radiant heat irradiated from the second heating source 26 is reflected by the second reflection surface 34 of the reflection plate 27, is transmitted through the transparent hollow roller 24 and reaches the upper portion and the left and right side portions of the inner circumference face of the heating belt 22. This heats the upper portion and the left and right side portions of the heating belt 22.

The radiant heat irradiated from the second heating source 26 toward the lower portion of the inner circumference face of the heating belt 22 is reflected by the second reflection surface 34 of the reflection plate 27 and therefore does not reach the lower portion of the inner circumference face of the heating belt 22. And, since the first heating source 25 is not operated (lighted), radiant heat irradiated from the first heating source 25 does not reach the lower portion of the inner circumference face of the heating belt 22. Accordingly, the lower portion of the heating belt 22 is not locally heated up to high temperatures so that it is prevented to escape the heat generated from the heating belt 22 to the pressing roller 23 and the hollow roller 24 via the fixing nip 31.

As the heating belt 22 is heated by the second heating source 26 as mentioned above, the heating belt 22 is increased in temperature. And, when the temperature of the heating belt detected by the temperature sensor 28 reaches the sheet-passable temperature T stored in the storage part 35, the controller 37 operates (lights) the first heating source 25 and also stops the operation of the second heating source 26. The time at which the first heating source 25 is operated is set to a time t2.

When the first heating source 25 is operated as mentioned above, the first heating source 25 irradiates radiant heat. A part of the radiant heat irradiated from the first heating source 25 is transmitted through the transparent hollow roller 24 and reaches the lower portion of the inner circumference face of the heating belt 22. Another part of the radiant heat irradiated from the first heating source 25 is reflected by the first reflection surface 33 of the reflection plate 27, is transmitted through the transparent hollow roller 24 and reaches the lower portion of the inner circumference face of the heating belt 22. This heats the lower portion of the heating belt 22 intensively.

The radiant heat irradiated from the first heating source 25 toward the upper portion and the left and right side portions of the inner circumference face of the heating belt 22 is reflected by the first reflection surface 33 of the reflection plate 27 toward the lower portion of the heating belt 22 and therefore does not reach the upper portion and the left and right side portions of the inner circumference face of the heating belt 22.

When the heating belt 22 is heated to the sheet-passable temperature T at the time t2 as mentioned above, the controller 37 controls the driving source 36 to rotate the hollow roller 24 in one direction. Then, the heating belt 22 which comes in contact with the hollow roller 24 is rotated in the one direction and the pressing roller 23 pressed against the heating belt 22 is rotated in a direction opposite to the one direction. Under this condition, when a sheet is conveyed from the upstream side of the conveying path 15 (from the right side in the embodiment), the sheet passes through the fixing nip 31. Then, the sheet is heated and pressed to fix the toner image on the sheet. The first heating source 25 is being continuously operated at least until the sheet passes through the fixing nip 31. The operation of the second heating source 26 is stopped at least until the sheet passes through the fixing nip 31.

In the embodiment, after the heating for the heating belt 22 by the second heating source 26 is started until the heating belt 22 is heated to the sheet-passable temperature T, an operation rate of the second heating source 26 (100% in the embodiment) is higher than an operation rate of the first heating source 25 (0% in the embodiment). With this, an amount of radiant heat from the second heating source 26 is larger than an amount of radiant heat from the first heating source 25. Accordingly, it becomes possible to effectively heat the upper portion and the left and right side portions of the heating belt 22 (the portion spaced away from the fixing nip 31) by the radiant heat irradiated from the second heating source 26 and to prevent the heat from escaping from the heating belt 22 to the pressing roller 23 and the hollow roller 24 via the fixing nip 31. This allows shortening of the warm-up time and energy saving.

In the embodiment, specifically, after the heating for the heating belt 22 by the second heating source 26 is started until the heating belt 22 is heated to the sheet-passable temperature T, the second heating source 26 is continuously operated and the operation of the first heating source 25 is stopped. In other words, after the heating for the heating belt 22 by the second heating source 26 is started until the heating belt 22 is heated to the sheet-passable temperature T, the operation rate of the first heating source 25 is set to 0% and the operation rate of the second heating source 26 is set to 100%. Therefore, it is possible to prevent the heat from escaping from the heating belt 22 to the pressing roller 23 and the hollow roller 24 via the fixing nip 31 more effectively and also to effectively heat the upper portion and the left and right side portions of the heating belt 22 by the radiant heat irradiated from the second heating source 26.

After the heating belt 22 is heated to the sheet-passable temperature T, the operation rate of the first heating source 25 (100% in the embodiment) becomes higher than the operation rate of the second heating source 26 (0% in the embodiment). With this, an amount of radiant heat from the first heating source 25 becomes larger than an amount of radiant heat from the second heating source 26. Therefore, it is possible to heat the lower portion of the heating belt 22 (the fixing nip 31 side portion) intensively. And, if the sheet may take heat from the fixing nip 31, the temperature of the heating belt 22 hardly drops lower than the sheet-passable temperature T.

In the embodiment, specifically, after the heating belt is heated to the sheet-passable temperature T, the operation of the second heating source 26 is stopped and the first heating source 25 is being continuously operated. In other words, after the heating belt 22 is heated to the sheet-passable temperature T, the operation rate of the first heating source 25 is set to 100% and the operation rate of the second heating source 26 is set to 0%. Therefore, it is possible to heat the lower portion of the heating belt 22 (the fixing nip 31 side portion) by the radiant heat irradiated from the first heating source 25 more intensively. And, it is possible to prevent the temperature of the heating belt 22 from dropping lower than the sheet-passable temperature T more effectively.

Furthermore, since the heating belt 22 is provided around the hollow roller 24, the heating belt 22 can be supported from inside by the hollow roller 24. This can prevent the heating belt 22 from being deformed by the nip pressure so that it is possible to lower a rigidly of the heating belt 22 and to thin the heating belt 22. Accordingly, it becomes possible to reduce a thermal capacity of the heating belt 22 and to heighten a heat response performance of the heating belt 22. This further allows shortening of the warm-up time and energy saving.

Owing to the good heat response performance of the heating belt 22 as mentioned above, if heat is taken by the sheet passed through the fixing nip 31, the heat can be compensated enough by the first heating source 25. Accordingly, in terms of temperature, it is not required to support the heating belt 22 by the heat generated from the pressing roller 23 and to maintain the temperature of the pressing roller 23 at high temperatures during the warm-up time. This point also allows energy saving.

Furthermore, since the hollow roller 24 has transparency, the radiant heat irradiated from the first heating source 25 and the second heating source 26 is transmitted through the hollow roller 24 and reaches the heating belt 22. This allows effective heating of the heating belt and further shortening the warm-up time. In the embodiment, specifically, since the inner circumference face of the substrate layer 29 of the heating belt 22 (which is also the inner circumference face of the entire of the heating belt 22) is coated with the coating which changes an infrared ray into heat, it becomes possible to more heighten the heat response performance of the heating belt 22.

Still more, since the heating belt 22 is formed by laminating transparent resins, the heating belt 22 can have transparency. This allow the sheet being passed through the fixing nip 31 to be directly irradiated by the radiant heat from the first heating source 25 and the second heating source 26 so as to heighten the heat absorbing performance of the sheet. In the embodiment, specifically, since the first heating source 25 and the second heating source 26 are composed of the carbon lamp, the heat absorbing performance of the sheet can be further heightened.

Still more, since the lower portion of the outer circumference face of the hollow roller 24 (the fixing nip 31 side portion) comes in contact with the lower portion of the inner circumference face of the heating belt 22 (the fixing nip side 31 portion), it is possible to prevent the heating belt from being deformed by the fixing pressure more effectively. And, the upper portion and the left and right side portions of the outer circumference face of the hollow roller 24 (the portion spaced away from the fixing nip 31) is provided away from the upper portion and the left and right side portions of the inner circumference face of the heating belt 22 (the portion spaced away from the fixing nip 31) with the gap in between.

Accordingly, compared with a case in which the hollow roller 24 comes in contact with the heating belt 22 in the entire of the circumferential direction thereof, it is possible to decrease a contact area of the hollow roller 24 and the heating belt 22. This can prevent the heat generated from the heating belt 22 from escaping to the hollow roller 24 so as to further shorten the warm-up time.

In the embodiment, the driving source 36 is connected to the hollow roller 24, in another different embodiment, the driving source 36 may be connected to the pressing roller 23.

In the embodiment, the heating member is composed of the heating belt 22, in another different embodiment, the heating member may be composed of a heating roller. In such a case, the hollow roller 24 may not be provided inside the heating roller.

In the embodiment, after the heating for the heating belt 22 is started until the heating belt 22 is heated to the sheet-passable temperature T, the operation rate of the second heating source 26 is set to 100% and the operation rate of the first heating source 25 is set to 0%. However, in another embodiment, after the heating for the heating belt 22 is started until the heating belt 22 is heated to the sheet-passable temperature T, the operation rate of the second heating source 26 may be set smaller than 100% (for example, 90%) by stopping the operation of the second heating source 26 temporarily. Alternatively, the operation rate of the first heating source 25 may be set larger than 0% (for example, 10%) by operating the first heating source 25 temporarily. That is, the operation rates of the first heating source 25 and the second heating source 26 after the heating for the heating belt 22 is started until the heating belt 22 is heated to the sheet-passable temperature T can be suitably changed within a range satisfying a condition in which an amount of radiant heat from the second heating source 26 is larger than an amount of radiant heat from the first heating source 25. And, a period in which the first heating source 25 and the second heating source 26 are operated together may exist.

In the embodiment, after the heating belt 22 is heated to the sheet-passable temperature T, the operation rate of the first heating source 25 is set to 100% and the operation rate of the second heating source 26 is set to 0%. However, in another embodiment, after the heating belt 22 is heated to the sheet-passable temperature T, the operation rate of the first heating source 25 may be set smaller than 100% (for example, 90%) by stopping the operation of the first heating source 25 temporarily. Alternatively, the operation rate of the second heating source 26 may be set larger than 0% (for example, 10%) by operating the second heating source 26 temporarily. That is, the operation rates of the first heating source 25 and the second heating source 26 after the heating belt 22 is heated to the sheet-passable temperature T can be suitably changed within a range satisfying a condition in which an amount of radiant heat from the first heating source 25 is larger than an amount of radiant heat from the second heating source 26. And, a period in which the first heating source 25 and the second heating source 26 are operated together may exist.

In the embodiment, the substrate layer 29 of the heating belt 22 is made from transparent resin, such as PI (polyimide), in another embodiment, the substrate layer 29 of the heating belt 22 may be made from metal, such as stainless steel and nickel. In the embodiment, the release layer 30 of the heating belt 22 is made of a tube of transparent fluororesin, such as PFA, in another embodiment, the release layer 30 of the heating belt 22 may be made from a coating layer of fluororesin, such as PTFE (Polytetrafluoroethylene).

In the embodiment, the heating belt 22 is composed of the substrate layer 29 and the release layer 30. However, in another embodiment, when the configuration of the present disclosure may be applied to a color image forming apparatus such as a color printer, an elastic layer may be formed between the substrate layer 29 and the release layer 30. In such a case, if the elastic layer is made from transparent resin (for example, transparent silicon rubber) and also the substrate layer 29 and the release layer 30 are made from transparent resin similar to the embodiment, the heating belt 22 is formed by laminating the transparent resins similar to the embodiment. Accordingly, it becomes possible to directly irradiate the sheet passed through the fixing nip 31 with the radiant heat from the first heating source 25 and the second heating source 26 and therefore to heighten the heat absorbing performance of the sheet.

In the embodiment, the first heating source 25 and the second heating source 26 are composed of a carbon lamp, in another embodiment, the first heating source 25 and the second heating source 26 may be composed of a halogen lamp, a ceramics heater, a IH (induction heating) heater or the like.

In the embodiment, the temperature sensor 28 is a non-contact type sensor, in another embodiment, the temperature sensor 28 may be a contact type sensor. Alternatively, the contact type sensor and the non-contact type sensor may be used together as the temperature sensor 28.

In the embodiment, the reflection plate 27 has the first reflection surface 33 and the second reflection surface 34, in another embodiment, the reflection plate 27 may not have the second reflection surface 34.

In the embodiment, the configuration of the disclosure is applied to the printer 1, in another embodiment, the configuration of the disclosure may be applied to a copying machine, a facsimile, a multifunction peripheral or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a heating member rotatably provided;

a pressing member rotatably provided and pressed against the heating member to form a fixing nip between the heating member and the pressing member;

a first heating source and a second heating source housed in the heating member;

a reflection body housed in the heating member and configured to reflect radiant heat irradiated from the first heating source toward a fixing nip side portion of the heating member and block radiant heat irradiated from the second heating source toward the fixing nip side portion of the heating member;

a storage part storing a sheet-passable temperature at which a toner image can be fixed on a sheet at the fixing nip; and a controller which controls operation/stop of the operation of the first heating source and the second heating source so as to make an amount of radiant heat from the second heating source larger than an amount of radiant heat from the first heating source after the heating of the heating member by the second heating source is started until the heating member is heated to the sheet-passable temperature and so as to make an amount of radiant heat from the first heating source larger than an amount of radiant heat from the second heating source after the heating member is heated to the sheet-passable temperature, wherein the controller is configured to continuously operate the second heating source and to stop the operation of the first heating source after the heating of the heating member by the second heating source is started until the heating member is heated to the sheet-passable temperature, and to stop the operation of the second heating source and to continuously operate the first heating source after the heating member is heated to the sheet-passable temperature.

2. The fixing device according to claim 1, further comprising a hollow roller having transparency and housing the first heating source and the second heating source, wherein the heating member is a heating belt provided around the hollow roller.

3. The fixing device according to claim 2, wherein the fixing nip side portion of the hollow roller comes in contact with the fixing nip side portion of the heating belt, and a portion spaced away from the fixing nip of the hollow roller is provided away from a portion spaced away from the fixing nip of the heating belt with a gap in between.

4. The fixing device according to claim 2, wherein the heating belt is formed by laminating transparent resins.

5. The fixing device according to claim 2, wherein the heating belt has a substrate layer made from metal.

6. The fixing device according to claim 1, wherein the controller is configured to stop the operation of the second heating source and to continuously operate the first heating source after the heating member is heated to the sheet-passable temperature at least until the sheet is passed through the fixing nip.

7. A fixing device comprising:

a heating member rotatably provided;

a pressing member rotatably provided and pressed against the heating member to form a fixing nip between the heating member and the pressing member;

a first heating source and a second heating source housed in the heating member;

a reflection body housed in the heating member and configured to reflect radiant heat irradiated from the first heating source toward a fixing nip side portion of the heating member and block radiant heat irradiated from the second heating source toward the fixing nip side portion of the heating member;

a storage part storing a sheet-passable temperature at which a toner image can be fixed on a sheet at the fixing nip; and a controller which controls operation/stop of the operation of the first heating source and the second heating source so as to make an amount of radiant heat from the second heating source larger than an amount of radiant heat from the first heating source after the heating of the heating member by at least either one of the first heating source and the second heating source is started until the heating member is heated to the sheet-passable temperature and so as to make an amount of radiant heat from the first heating source larger than an amount of radiant heat from the second heating source after the heating member is heated to the sheet-passable temperature, wherein the first heating source and the second heating source are positioned on a straight line passing through a center of the fixing nip and a rotational center of the heating member.

8. The fixing device according to claim 7, wherein the reflection body is symmetrical relative to the straight line.

9. The fixing device according to claim 1, wherein the inner circumference face of the heating member is coated with a coating material which changes an infrared ray into heat.

10. An image forming apparatus comprising a fixing device, wherein the fixing device including:

a heating member rotatably provided;

a pressing member rotatably provided and pressed against the heating member to form a fixing nip between the pressing member and the heating member;

a first heating source and a second heating source housed in the heating member;

a reflection body housed in the heating member and configured to reflect radiant heat irradiated from the first heating source toward a fixing nip side portion of the heating member and block radiant heat irradiated from the second heating source toward the fixing nip side portion of the heating member;

a storage part storing a sheet-passable temperature at which a toner image can be fixed on a sheet at the fixing nip; and a controller which controls operation/stop of the operation of the first heating source and the second heating source so as to make an amount of radiant heat from the second heating source larger than an amount of radiant heat from the first heating source after the heating of the heating member by the second heating source is started until the heating member is heated to the sheet-passable temperature and so as to make an amount of radiant heat from the first heating source larger than an amount of radiant heat from the second heating source after the heating member is heated to the sheet-passable temperature, wherein the controller is configured to continuously operate the second heating source and to stop the operation of the first heating source after the heating of the heating member by the second heating source is started until the heating member is heated to the sheet-passable temperature, and to stop the operation of the second heating source and to continuously operate the first heating source after the heating member is heated to the sheet-passable temperature.

11. The image forming apparatus according to claim 10, wherein the fixing device further includes a hollow roller having transparency and housing the first heating source and the second heating source, wherein the heating member is a heating belt provided around the hollow roller.

12. The image forming apparatus according to claim 11, wherein the fixing nip side portion of the hollow roller comes in contact with the fixing nip side portion of the heating belt, and a portion spaced away from the fixing nip of the hollow roller is provided away from a portion spaced away from the fixing nip of the heating belt with a gap in between.

13. The image forming apparatus according to claim 11, wherein the heating belt is formed by laminating transparent resins.

14. The image forming apparatus according to claim 11, wherein the heating belt has a substrate layer made from metal.

15. The image forming apparatus according to claim 10, wherein the controller is configured to stop the operation of the second heating source and to continuously operate the first heating source after the heating member is heated to the sheet-passable temperature at least until the sheet is passed through the fixing nip.

16. The image forming apparatus according to claim 10, wherein the first heating source and the second heating source are positioned on a straight line passing through a center of the fixing nip and a rotational center of the heating member.

17. The image forming apparatus according to claim 16, wherein the reflection body is symmetrical relative to the straight line.

18. The image forming apparatus according to claim 10, wherein the inner circumference face of the heating member is coated with a coating material which changes an infrared ray into heat.

* * * * *